US007973735B2

(12) United States Patent
Kim et al.

(10) Patent No.: US 7,973,735 B2
(45) Date of Patent: Jul. 5, 2011

(54) EXTENDABLE SWIVEL ANTENNA

(75) Inventors: Keyng Hun Kim, Tongyeong-si (KR); Seung Kyo Park, Daejeon (KR); Chan Kuk Kim, Daejeon (KR)

(73) Assignee: Menix Co., Ltd., Daejeon (KR)

( * ) Notice: Subject to any disclaimer, the term of this patent is extended or adjusted under 35 U.S.C. 154(b) by 0 days.

(21) Appl. No.: 12/280,988

(22) PCT Filed: Jul. 10, 2008

(86) PCT No.: PCT/KR2008/004058

§ 371 (c)(1),
(2), (4) Date: Jul. 28, 2010

(87) PCT Pub. No.: WO2009/011515

PCT Pub. Date: Jan. 22, 2009

(65) Prior Publication Data

US 2010/0283708 A1 Nov. 11, 2010

(30) Foreign Application Priority Data

Jul. 13, 2007 (KR) ..... 10-2007-0011532
Mar. 3, 2008 (KR) ..... 10-2008-0019575

(51) Int. Cl.
*H01Q 1/10* (2006.01)
*H01Q 9/30* (2006.01)

(52) U.S. Cl. ..... 343/889; 343/882; 343/883; 343/900; 343/901; 343/702

(58) Field of Classification Search ..... 343/888, 343/889

See application file for complete search history.

(56) References Cited

U.S. PATENT DOCUMENTS

| | | | | |
|---|---|---|---|---|
| 5,079,558 | A * | 1/1992 | Koike | 343/702 |
| 6,046,706 | A * | 4/2000 | Vargas | 343/883 |
| 6,847,830 | B1 * | 1/2005 | Vanderhelm et al. | 455/558 |
| 7,358,926 | B2 * | 4/2008 | Komoto et al. | 343/900 |
| 7,425,925 | B2 * | 9/2008 | Cheang et al. | 343/711 |
| 2004/0090383 | A1 * | 5/2004 | Wang et al. | 343/702 |
| 2007/0247376 | A1 * | 10/2007 | Kim et al. | 343/702 |
| 2007/0285333 | A1 * | 12/2007 | Chan et al. | 343/888 |

* cited by examiner

*Primary Examiner* — Trinh V Dinh
(74) *Attorney, Agent, or Firm* — LRK Patent Law Firm

(57) ABSTRACT

Disclosed is an extendable swivel antenna, specifically a swivel antenna with enhanced durability, which can prevent deformation of a hinge unit and an outermost antenna covering the hinge unit. The swivel antenna includes: a power feeding unit 110 electrically connected to a terminal 200; an antenna unit 120 for transmitting a radio wave received from an external to the power feeding unit 110, which is folded in multiple stages and can extend; and a hinge unit 130 for connecting between the power feeding unit 110 and the antenna unit 120 and for swiveling the antenna unit 120, wherein the hinge unit 130 includes an insertion portion 131 connected to the antenna unit 120, a recess portion 132 connected to the power feeding unit 110 and having a step portion 132*s* whose diameters of one side and the other side are different from each other, and a hinge pin 133 for fixing the an insertion portion 131 and the recess portion 132, wherein the antenna unit 120 includes a whip antenna 121 fixed to the insertion portion 131, one or more road antennas 122, 123, and 124 to be folded about the whip antenna 121, and wherein one side 132*c* of the recess portion 132 whose internal diameter is smaller than that of the other side 132*d* of the recess portion 132 is housed in the outermost road antenna 124 of the folding one or more road antennas 122, 123, and 124.

3 Claims, 8 Drawing Sheets

EXTENDABLE SWIVEL ANTENNA

TECHNICAL FIELD

The present invention relates to an extendable swivel antenna, and more particularly to an extendable swivel antenna with enhanced durability, which can prevent deformation of a hinge unit and an outermost antenna covering the hinge unit.

BACKGROUND ART

Generally, antennas for transmitting/receiving radio waves can be classified into a road antenna, and a micro strip antenna, etc. Recently, according to the trend of reduction in the thickness and the size of various terminals, space for an antenna to be housed in the terminal is reduced. Therefore, an extendable road antenna has become commercially available, whose length is shortened to be housed and lengthened to be used according to its usable frequency bands as needed.

According to recent rapid increase in the use of terminals provided with a digital multimedia broadcasting (DMB) function, it becomes the trend that many terminals are employing a swivel antenna, which allows use of an extendable road antenna bendable in various angles in order to receive good quality of radio waves.

FIG. 1 illustrates a conventional swivel antenna inserted into a terminal, and FIG. 2 illustrates the swivel antenna in FIG. 1, which has been extended and is swiveling. Further, FIG. 3 illustrates a conventional swivel antenna to be inserted into a terminal.

Referring to FIGS. 1 and 2, a conventional swivel antenna 10 includes a power feeding unit 11 electrically connected to a terminal 20, an antenna unit 12 folded in multiple stages, and a hinge unit 13 provided between the power feeding unit 11 and the antenna unit 12. In normal times, the swivel antenna 10 is folded in multiple stages to be seated in a space 20*a* provided in the terminal 20. In contrast, while receiving radio waves, the stages of the antenna unit 12 are extended for use of the swivel antenna 10. Here, the antenna unit 12 includes a whip antenna 12*a* with elasticity, and thus is prevented from damage when the antenna unit 12 is swiveled by the hinge unit 13. This swivel antenna 10 swivels in a predetermined direction R1 around a hinge pin 13*a* of the hinge unit 13 as an axis.

In the above-mentioned conventional swivel antenna 10, force is applied from the upper portion to the lower portion of the antenna unit 12 in order to insert the antenna unit 12 folded in the multiple stages into the terminal 20. However, as shown in FIG. 2, if a force F1 in an inclined direction is applied to the antenna unit 12, the hinge unit 13 is bent in a direction R2 opposite to a bending direction, resulting in cracks in a recess portion 13*b* thereof. The above deformation or damage of the hinge unit 13 decreases durability of the swivel antenna 10, and leads to customer dissatisfaction.

DISCLOSURE

Technical Problem

The present invention has been made to solve the above problems, and an object of the present invention is to provide a swivel antenna with enhanced durability, which can prevent deformation of a hinge unit and an outermost antenna covering the hinge unit.

Technical solution

A swivel antenna according to the present invention includes: a power feeding unit 110 electrically connected to a terminal 200; an antenna unit 120 for transmitting radio waves received from the outside to the power feeding unit 110, the antenna unit 120 being folded in multiple stages to be extendable and retractable, and a hinge unit 130 for connecting between the power feeding unit 110 and the antenna unit 120 and for swiveling the antenna unit 120, wherein the hinge unit 130 includes: an insertion portion 131 connected to the antenna unit 120, a recess portion 132 connected to the power feeding unit 110 and having a step portion 132*s* in which diameters of one side and the other side are different from each other, and a hinge pin 133 for fixing the insertion portion 131 and the recess portion 132, wherein the antenna unit 120 includes: a whip antenna 121 fixed to the insertion portion 131, and one or more road antennas 122, 123, and 124 to be folded about the whip antenna 121, and wherein one side 132*c* of the recess portion 132 whose internal diameter is smaller than that of the other side 132*d* of the recess portion 132 is housed in the outermost road antenna 124 of the folding one or more road antennas 122, 123, and 124. Here, a folded end portion 124*s* of the outermost road antenna 124 is located at the step portion 132*s* of the recess portion 132. Further, one side 132*c* of the recess portion 132 has a diameter smaller than that of the folded end portion 124*s* of the outermost road antenna 124, and the other side 132*d* of the recess portion 132 has a diameter larger than that of the folded end portion 124*s* of the outermost road antenna 124.

Advantageous Effects

According to an extendable swivel antenna of the present invention, a third road antenna formed at the outermost one of antenna units folded in multiple stages houses one side of a recess portion, thereby a coupling portion of a hinge unit is prevented from deformation by external force.

Further, according to the present invention, since the hinge unit is protected by the antenna unit, durability is relatively increased, so that user's confidence in products is increased.

BRIEF DESCRIPTION OF THE DRAWINGS

The foregoing and other objects, features and advantages of the present invention will become more apparent from the following detailed description when taken in conjunction with the accompanying drawings in which.

BEST MODE

Mode for Invention

Figure 1:
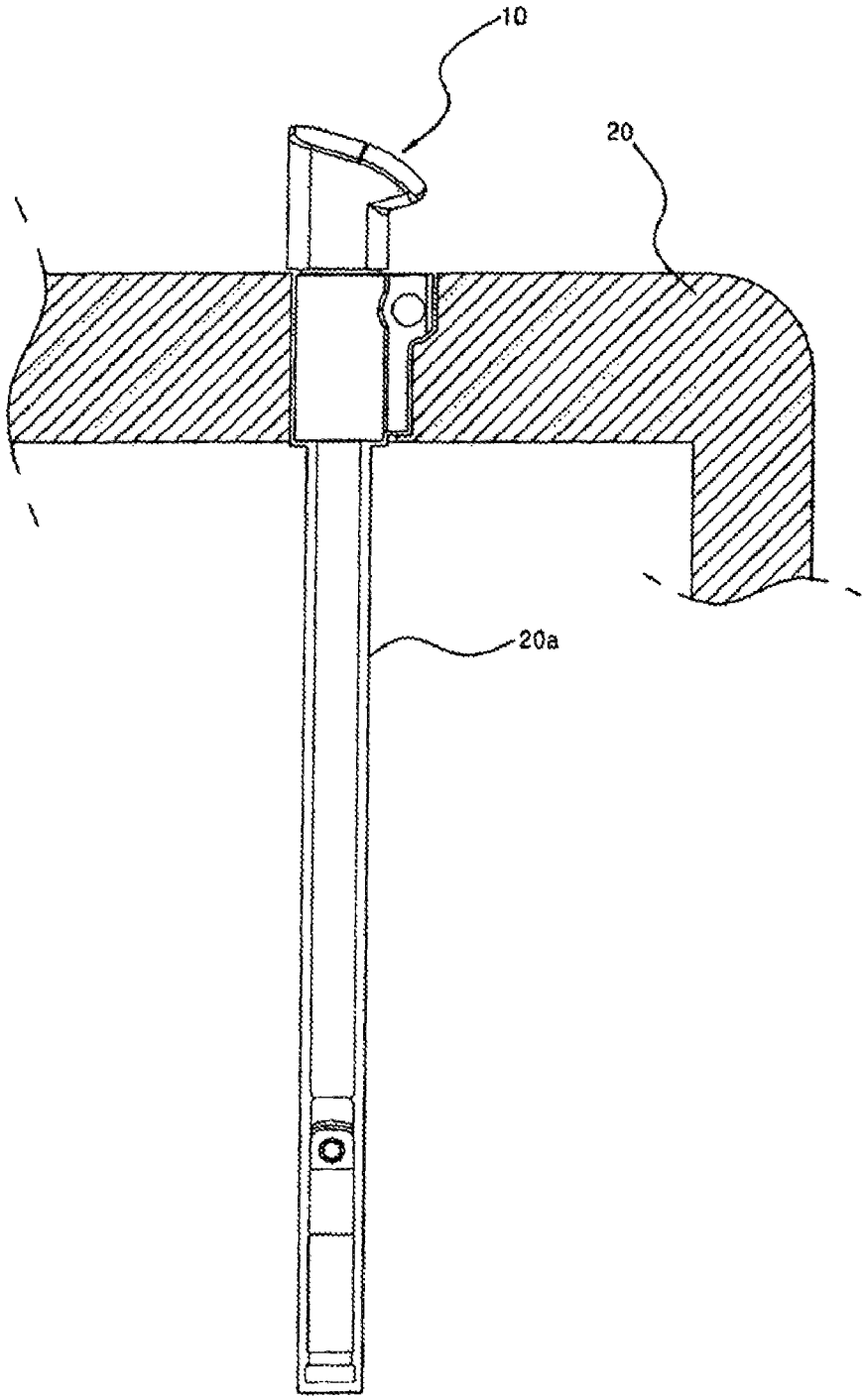
FIGURE 1 PRIOR ART
FIG. 1 is a diagram illustrating a conventional swivel antenna inserted in a terminal.
Figure 2:
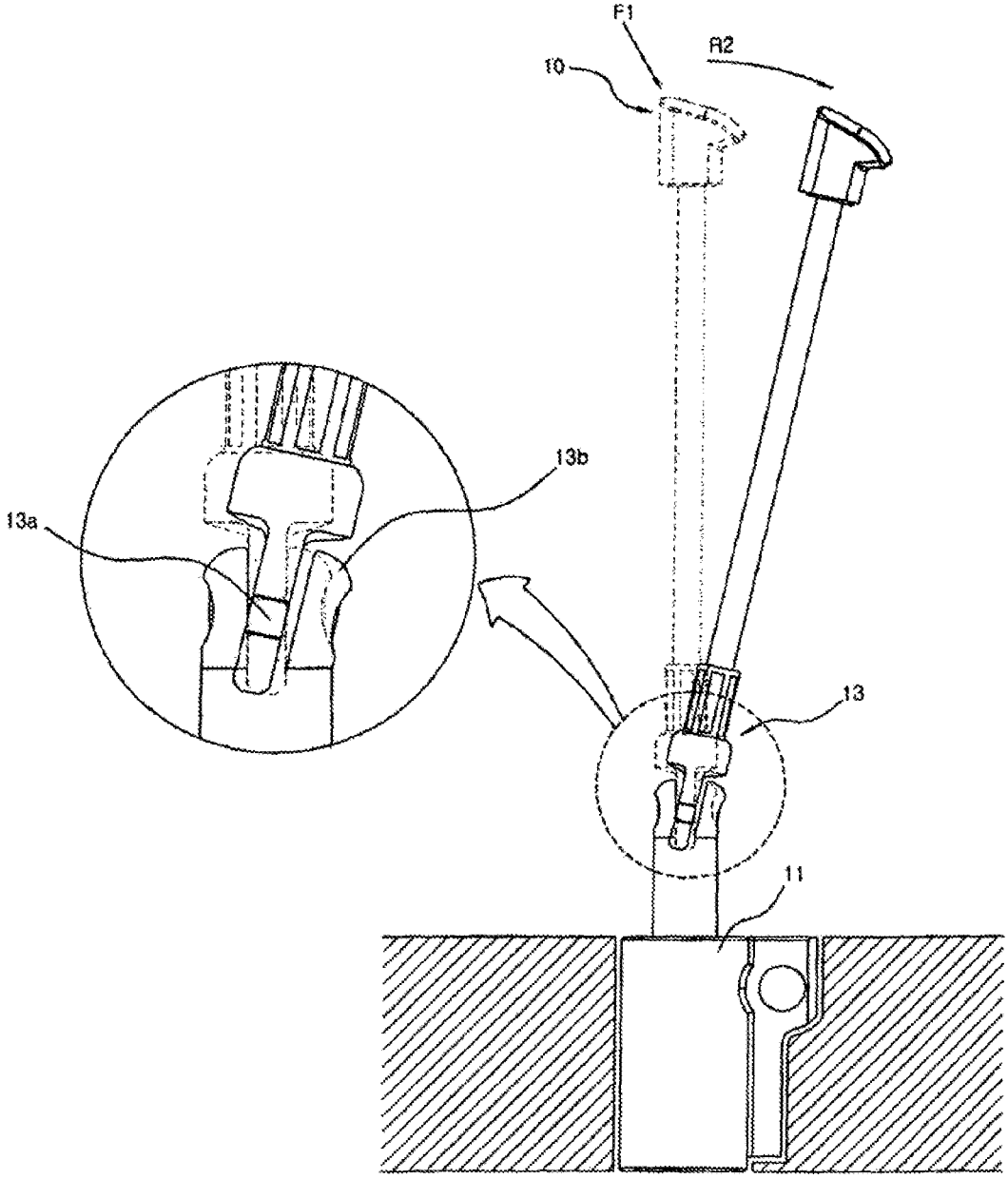
FIGURE 2 PRIOR ART
FIG. 2 is a diagram illustrating the swivel antenna in FIG. 1, which has been extended and is swiveling.
Figure 3:
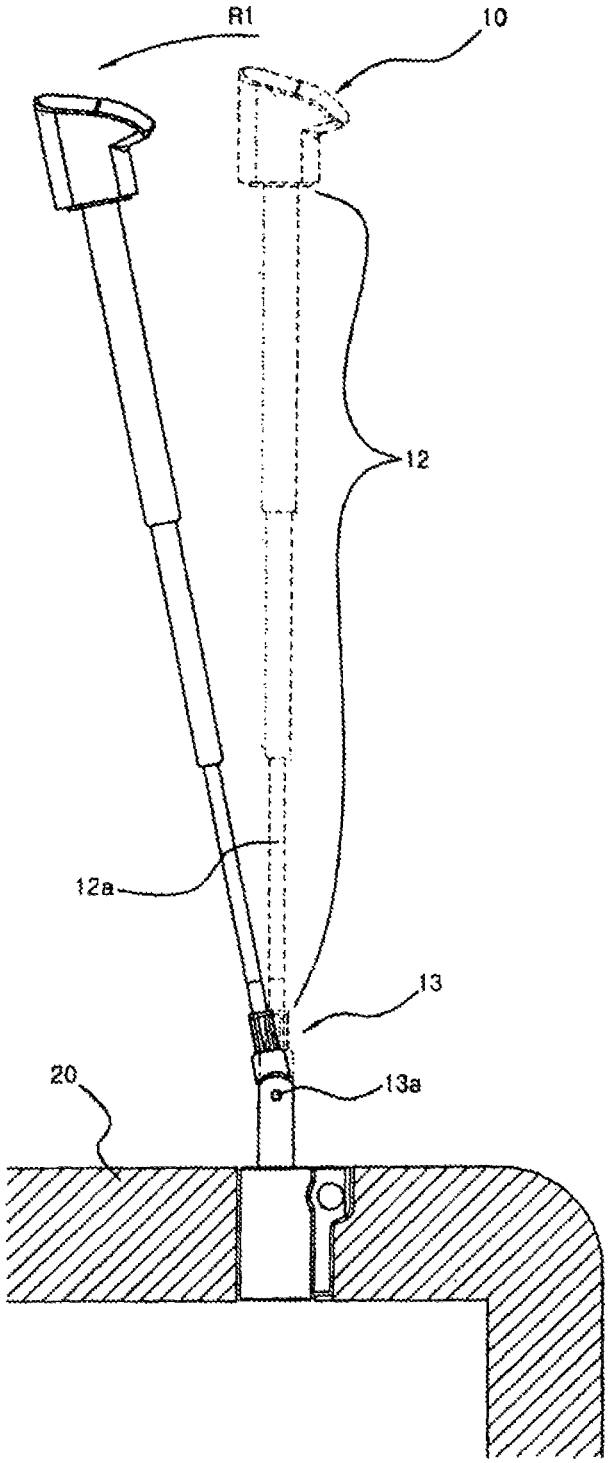
FIGURE 3 PRIOR ART
FIG. 3 is a diagram illustrates a conventional swivel antenna is being inserted into a terminal.

Hereinafter, an extendable swivel antenna according to the present invention will now be described in detail with reference to the accompanying diagrams and embodiments. The present invention will omit the details of unrelated portions in the descriptions in order to describe clearly, and in the following descriptions, the same elements will be designated by the same reference numeral.

First, the extendable swivel antenna according to an embodiment of the present invention will be described.

Figure 4:
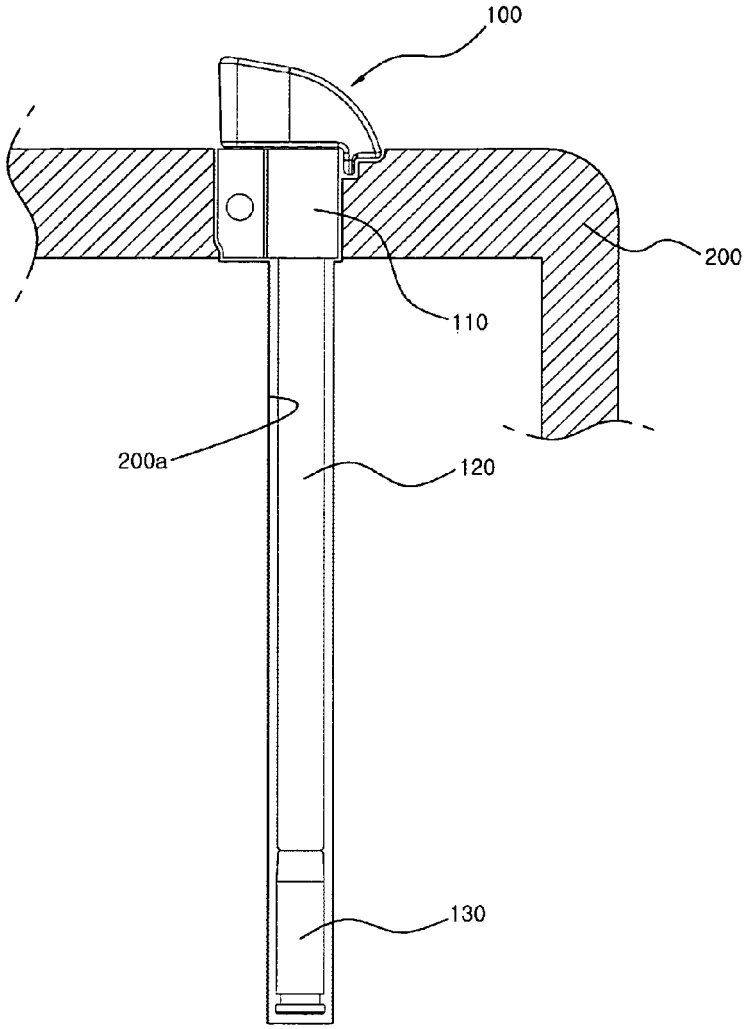
FIG. 4 is a diagram illustrating a swivel antenna inserted in a terminal according to an embodiment of the present invention.
Figure 5:
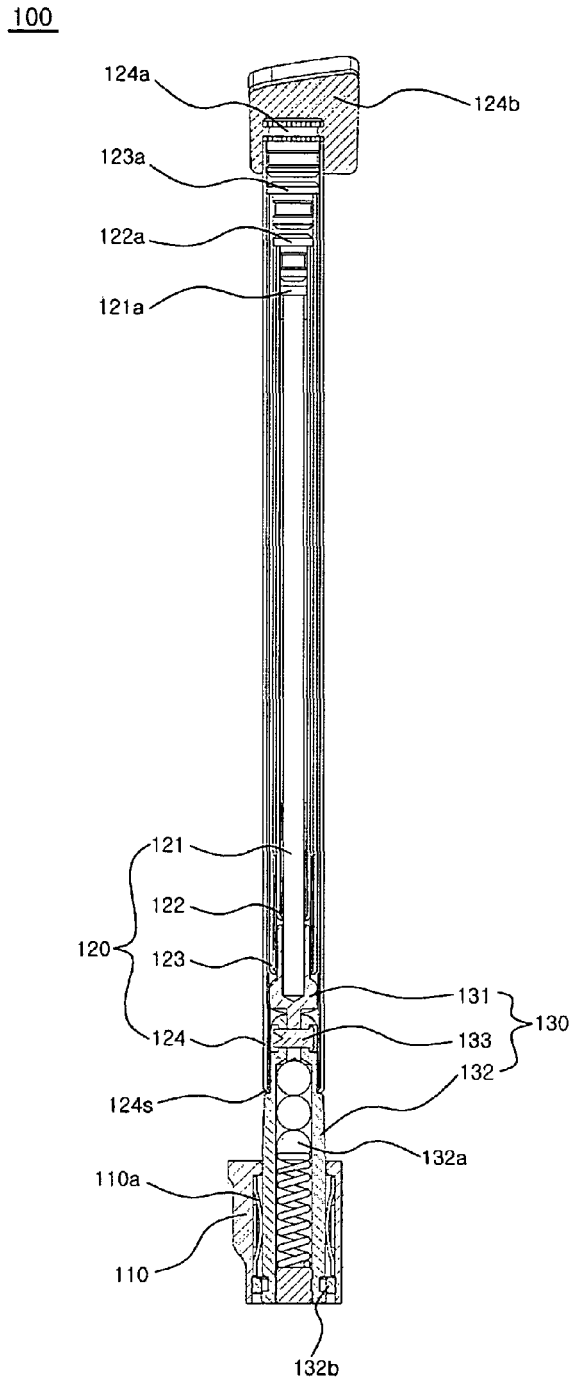
FIG. 5 is a cross-sectional diagram of a swivel antenna according to an embodiment of the present invention.

FIG. 4 shows a diagram illustrating a swivel antenna inserted in a terminal according to an embodiment of the present invention, and FIG. 5 shows a cross-sectional diagram of a swivel antenna according to an embodiment of the present invention. Further, FIG. 6 shows a plan diagram illustrating the swivel antenna in FIGS. 4 and 5 whose antenna unit is extended.

Figure 6:
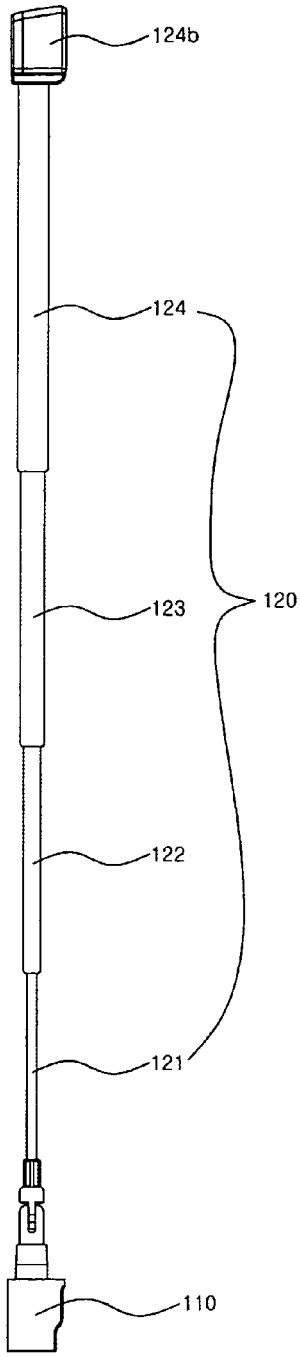
FIG. 6 is a plan diagram illustrating the swivel antenna in FIGS. 4 and 5 whose antenna unit is extended.

Referring to FIGS. 4 to 6, the swivel antenna 100 according to an embodiment of the present invention may include a power feeding unit 110, an antenna unit 120 and a hinge unit 130. The swivel antenna 100 according to the present invention is kept within a space 200*a* provided in a terminal 200. Since the hinge unit 130 is housed by the folded antenna unit 120, the hinge unit 130 of the swivel antenna 100 is preliminarily prevented from damage by a force applied for seating the swivel antenna 100 into the terminal 200.

First, a power feeding unit 110 transmits received radio waves to the terminal 200 connected thereto. Substantially, the power feeding unit 110 may be fixed to the terminal 200. Further, the power feeding unit 110 serves as a passage in order for an antenna unit 120 and the hinge unit 130 (to be described below) to be extended to the outside of the terminal 200. This power feeding unit 110 includes a fixing guide 110*a* for fixing a lower portion of the hinge unit 130, which helps the swivel antenna 100 not to be separated from the terminal 200. The fixing guide 110*a* includes a plate spring with elasticity, etc., and thus elastically fixes the hinge unit 130. It should be understood by those skilled in the art that this power feeding unit 110 may be made with various changes in form, and thus the above-mentioned description is not intended to limit the power feeding unit 110 of the present invention.

The antenna unit 120 is folded in multiple stages to be extendable and retractable, and transmits received radio waves to the power feeding unit 110. More particularly, the antenna unit 120 includes a whip antenna 121 with elasticity and the first to third road antennas 122 to 124 to be folded in multiple stages around the whip antenna 121. The whip antenna 121 is located at the innermost when the antenna unit 120 is folded, and is made of a material with elasticity in order to prevent deformation of the extended antenna unit 120. Here, a hinge unit 130 (to be described below) is fixed at one side of the whip antenna 121, and a head unit 121*a* having a relatively larger diameter than a body is formed at the opposite side, so that the first road antenna 122 is prevented from being separated at a time of extending. The first to third road antennas 122 to 124 are designed as a hollow bar-type antenna to be sequentially folded around the whip antenna 121. The end portions of one side the folded first to third road antennas 122 to 124 are seated to the hinge unit 130 (to be described below), respectively. In the opposite-side end portions, latch members 122*a* to 124*a* are formed in order for the upper end portion of the road antenna not to be separated.

According to the present invention, the third road antenna 124 formed at the outermost of the antenna unit 120 houses a part of a recess portion 132 of the hinge unit 130 (to be described below), thereby preventing deformation of the recess portion 132 by external force. That is, one side of the end portion 124*s* of the third road antenna 124 is seated to a part of the recess portion 132. In the opposite-side end portion, a head 124*b* is included, which is formed by molding on the latch member 124*a*. According to the present invention, there are illustrated three road antennas, but it will be apparent to those skilled in the art that the number of the road antennas may be one or two, as well as three or more.

The hinge unit 130 is connected between the power feeding unit 110 and the antenna unit 120 in order to swivel the antenna unit 120. More particularly, the hinge unit 130 includes an insertion portion 131, the recess portion 132, and a hinge pin 133 connecting them with each other. One side of the insertion portion 131 presses and fixes one side of the whip antenna 121 of the antenna unit 120. The other side thereof includes a protruding portion in which a housing hole for housing the hinge pin 133 is formed. In one side of the recess portion 132, the protruding portion of the insertion portion 131 is housed, and a groove portion provided with a housing hole for housing the hinge pin 133 is formed. In the other side, the power feeding unit 110 is connected. A guide member 132*a* is provided in the recess portion 132 in order to swivel the antenna unit 120. Further, a stopper 132*b* is provided at a distal end of the recess portion 132, which helps the hinge unit 130 not to be separated from the power feeding unit 110. The present invention will omit the detailed descriptions of swiveling operations of the antenna unit 120 which can be usually implemented by using the hinge unit 130. According to the present invention, the recess portion 132 includes a step portion 132*s* in which the diameters of one side connected to the hinge pin 133 and the other side connected to the power feeding unit 110 are different from each other. Here, one side of the recess portion 132 has a diameter smaller than that of the end portion 124*s* of the third road antenna 124 to be folded, and the other side of a recess portion 132 has a diameter larger than that of the end portion 124*s* of the third road antenna 124 to be folded. That is, the folded end portion 124*s* of the third road antenna 124 is seated to the step portion 132*s* of the recess portion 132, so that one side of a recess portion 132 is housed in the third road antenna 124.

Figure 7:
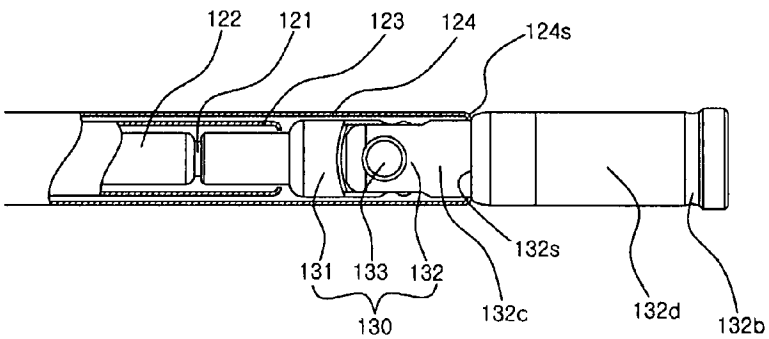
FIG. 7 is a perspective diagram illustrating a main portion of a swivel antenna according to an embodiment of the present invention.

FIG. 7 shows a perspective diagram illustrating a main portion of a swivel antenna 100 according to an embodiment of the present invention.

As shown in FIG. 7, the antenna unit 120 is folded in multiple stages, and each end portion is sequentially seated at the hinge unit 130. First, one side of the whip antenna 121 is fixed in the insertion portion 131. The first road antenna 122 houses the whip antenna 121 into its hollow inside, and the end portion to be folded is seated at the insertion portion 131. The second road antenna 123 houses the first road antenna 122 into its hollow inside, and the end portion to be folded is seated at the insertion portion 131. The third road antenna 124 houses the second road antenna 123 into its hollow inside, and the end portion 124*s* to be folded is seated at the recess portion 132. Here, the end portions of the first road antenna 122 and the second road antenna 123 to be folded may be seated at the recess portion 132, but are not limited to. According to the present invention, one side 132*c* of the recess portion 132 coupled with the hinge pin 133 includes the stopper 132*b*, and has a diameter smaller than that of the other side 132*d* of the recess portion 132 connected to the power feeding unit 110. Therefore, the step portion 132*s* is formed between one side 132*c* and the other side 132*d* of the recess portion 132. The end portion 124*s* of the folded third road antenna 124 is seated at the step portion 132*s*. An aperture portion for housing the second road antenna 123 is formed at the end portion 124*s* of the folded third road antenna 124. Therefore, the third road antenna 124 houses one side 132*c* of the recess portion 132 in a hollow inside.

Figure 8:
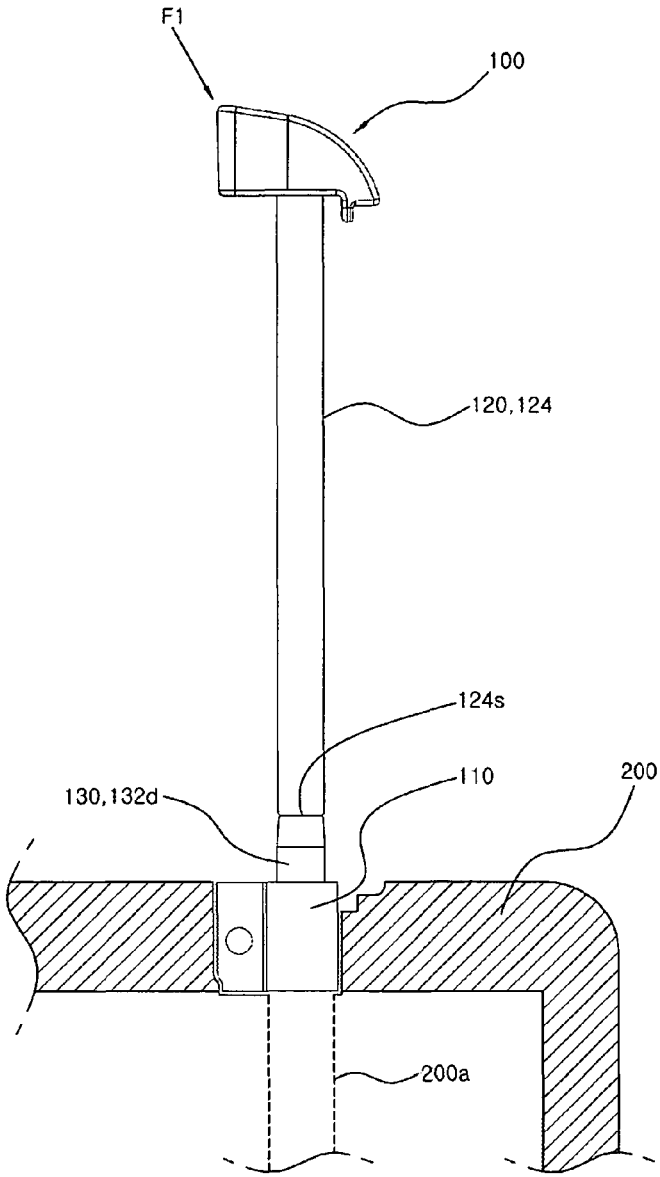
FIG. 8 is a diagram illustrating a swivel antenna is being inserted into a terminal according to the present invention.

FIG. 8 shows a diagram illustrating a swivel antenna is being inserted into a terminal according to the present invention.

As shown in FIG. 8, the swivel antenna 100 according to the present invention can be inserted into a space 200*a* provided in the terminal 200 with the antenna unit 120 folded completely. That is, before the swivel antenna 100 is inserted into the terminal 200, only the outermost third road antenna 124 is exposed to the outside. The folded end portion 124*s* of the third road antenna 124 is seated at the recess portion 132, so that houses one side of the recess portion 132. One side of the recess portion 132 housed in the third road antenna 124 substantially houses a portion where the insertion portion 131 and the recess portion 132 are coupled by the hinge pin 133. Therefore, the swivel antenna 100 is structured such that the third road antenna 124 houses the coupling portion of the hinge unit 130 susceptible to external force, and thus force F1 for inserting the swivel antenna 100 into the terminal 200 does not affect to the coupling portion of the hinge unit 130.

According to the embodiment of the present invention, since the third road antenna 124 formed at the outermost of the antenna unit 120 houses one side 132*c* of the recess portion 132, it can prevent deformation of the coupling portion of the hinge unit 130 by external force. That is, since a portion where the insertion portion 131 and the recess portion 132 of the hinge unit 130 are coupled by the hinge pin 133 is substantially a swiveling portion of the antenna unit 120, it may be relatively susceptible to external force. Therefore, when the swivel antenna 100 is inserted into the terminal 200, the third road antenna 124 located at the outermost houses one side of the recess portion 132 of the hinge unit 130, so that the coupling portion of the hinge unit 130 is not affected by external force. As a result, durability of the swivel antenna 100 is relatively increased, so that user's confidence in products is increased.

The present invention is not intended to limit to embodiments thereof. Further, it will be understood by those skilled in the art that various changes in form and details may be made therein without departing from the spirit and scope of the invention as defined by the appended claims.

The invention claimed is:

1. An extendable swivel antenna comprising:

a power feeding unit electrically connected to a terminal;

an antenna unit for transmitting radio waves received from the outside to the power feeding unit the antenna unit being folded in multiple stages to be extendable and retractable; and a hinge unit for connecting between the power feeding unit and the antenna unit and for swiveling the antenna unit , wherein the hinge unit comprises: an insertion portion connected to the antenna unit; a recess portion connected to the power feeding unit and having a step portion in which diameters of one side and the other side are different from each other; and a hinge pin for fixing the an insertion portion and the recess portion, the antenna unit comprises: a whip antenna fixed to the insertion portion; and one or more road antennas configured to be folded about the whip antenna and one side of the recess portion whose internal diameter is smaller than that of the other side of the recess portion is housed in the outermost road antenna of the folding one or more road antennas.

2. The extendable swivel antenna as claimed in claim 1, wherein a folded end portion of the outermost road antenna is located at the step portion of the recess portion.

3. The extendable swivel antenna as claimed in claim 2, wherein one side of the recess portion comprises a diameter smaller than that of the folded end portion of the outermost road antenna, and the other side of the recess portion has a diameter larger than that of the folded end portion of the outermost road antenna.

* * * * *